US005596920A

United States Patent [19]

Umemura et al.

[11] Patent Number: 5,596,920

[45] Date of Patent: Jan. 28, 1997

[54] SWASH PLATE TYPE COMPRESSOR

[75] Inventors: Satoshi Umemura; Hisato Kawamura; Toshiyuki Mizuno, all of Kariya, Japan; Michelle Alberda, Kuala Lumpur, Malaysia; Hayato Ikeda, Kariya, Japan; Tomoji Tarutani, Kariya, Japan; Keishi Nakagaki, Kariya, Japan; Yasunori Ueda, Kariya, Japan; Hideo Mori, Kariya, Japan; Kazuya Kimura, Kariya, Japan; Yuji Kaneshige, Kariya, Japan; Hirofumi Sato, Kariya, Japan

[73] Assignee: Kabushiki Kaisha Toyoda Jidoshokki Seisakusho, Kariya, Japan

[21] Appl. No.: 417,386

[22] Filed: Apr. 5, 1995

Related U.S. Application Data

[63] Continuation-in-part of Ser. No. 342,713, Nov. 21, 1994, Pat. No. 5,528,976.

[30] Foreign Application Priority Data

| | | | |
|---|---|---|---|
| Apr. 6, 1994 | [JP] | Japan | 6-068768 |
| Apr. 25, 1994 | [JP] | Japan | 6-086542 |
| May 2, 1994 | [JP] | Japan | 6-093482 |

[51] Int. Cl.[6] ..... F01B 3/00

[52] U.S. Cl. ..... 92/71; 417/269; 74/60

[58] Field of Search ..... 92/71; 417/269; 74/60; 91/499

[56] References Cited

U.S. PATENT DOCUMENTS

| | | | |
|---|---|---|---|
| 4,790,727 | 12/1988 | Steele | 92/71 |
| 4,950,132 | 8/1990 | Brian, Jr. et al. | 92/71 |

FOREIGN PATENT DOCUMENTS

| | | | |
|---|---|---|---|
| 3627652 | 3/1987 | Germany . | |
| 4006338 | 9/1990 | Germany . | |
| 4110647 | 10/1991 | Germany . | |
| 4404637 | 8/1994 | Germany . | |
| 4441721 | 6/1995 | Germany . | |
| 6241162 | 8/1994 | Japan | 417/269 |

*Primary Examiner*—Thomas E. Denion

*Attorney, Agent, or Firm*—Brooks Haidt Haffner & Delahunty

[57] ABSTRACT

A compressor includes a drive shaft rotatably supported on cylinder block. A swash plate rotates in accordance with rotation of the drive shaft. A plurality of pistons reciprocate in the associated bores in the cylinder block in accordance with the rotation of the swash plate. First an second thrust bearings are provided in the cylinder block at both sides of the swash plate, and receive the axial loads applied to the swash plate and drive shaft according to the reciprocation of the pistons. The first thrust bearing has the first seat portion clamped at both sides by the swash plate and cylinder block and the second seat portion located apart from one of the swash plate and cylinder block.

26 Claims, 11 Drawing Sheets

SWASH PLATE TYPE COMPRESSOR

This application is a continuation in part application of U.S. patent application Ser. No. 08/342,713 filed on Nov. 21, 1994, entitled SWASH PLATE TYPE COMPRESSOR now U.S. Pat. No. 5,528,976.

BACKGROUND OF THE INVENTION

1. Field of the Invention

The present invention generally relates to a swash plate type compressor, and, more particularly, to an improvement in the bearings that receive the load on the swash plate.

2. Description of the Related Art

In general, compressor units used in automobiles, trucks and the like are used to supply compressed gas to the vehicle's air conditioning system.

One common type of compressor utilizes a swash plate design having a plurality of double-headed pistons. The swash plate type compressor has a pair of cylinder blocks 110A and 110B as shown in FIG. 20. A drive shaft 111 is rotatably supported by the pair of cylinder blocks 110A and 110B. A swash plate 112 is mounted on the drive shaft 111. Thrust bearings 113 are respectively located between annular pressure receiving rib portions 112*a*, provided on the front and rear surfaces of the swash plate 112, and pressure receiving rib portions 110*a* of the cylinder blocks 110A and 110B. Each thrust bearing 113 has an annular inner race 113*a* and an annular outer race 113*b* which have different diameters.

The outer ends of both cylinder blocks 110A and 110B respectively abut housings 114 and 115. Bolts 116 securely fix the individual cylinder blocks 110A and 110B and the housings 114 and 115.

during the compressor's assembly, when the bolts 116 are tightened, each inner race 113*a* abuts on the associated pressure receiving rib portion 112*a* near its outer periphery. This bolt tightening action elastically deforms each inner race. The outer races 113*b* abut on the pressure receiving rib portions 110*a* of the cylinder blocks 110A and 110B in the vicinity of their inner peripheries.

When the swash plate 112 rotates, the pistons 117 reciprocate, compressing the refrigerant gas. The reaction force of the swash plate 112, in turn, acts as an axial load on the thrust bearings 113 via the pistons 117 and the swash plate 112. The axial load is applied to the thrust bearings 113 by pressure receiving rib portions 110*a*, 112*a*. Since the diameter of rib portion 112*a* is larger than that of rib portion 110*a*, a moment is created around the inner race 113*a* causing it to elastically deform when the axial load is applied to the bearings 113 by the swash plate 112. As schematically illustrated in FIG. 21, the thrust bearings 113 can be considered as equivalent to springs S positioned between both sides of the swash plate 112 an the cylinder blocks 110A and 110B.

At the time the refrigerant gas is compressed, however, the spring-like action of the thrust bearings 113 sets up a vibration which is transmitted to the swash plate 112. Moreover, when the drive shaft rotates at high speeds, a high frequency vibration is created and contributes to the noise produced by the compressor.

Japanese Unexamined Utility Model Publication No. 54-170410 discloses the structure of another thrust bearing. According to this structure, both outer surfaces of the boss portions of the swash plate and the two support surfaces of the cylinder blocks are formed flat. Here, the thrust bearings are held rigid between the outer surfaces of the boss portions and the opposing support surfaces.

The inner race of the thrust bearing contacts the outer surface of the boss portion at its entire side surface. With this structure, when a moment acts on the swash plate due to the pressure of the compressed gas, the inner race is pressed against the rollers, as if to cut into the rollers, applying an offset load to the rollers of the thrust bearing. This hastens the wear of the bearing. Consequently, the worn thrust bearings cause vibration and noise or power loss in the compressor.

SUMMARY OF THE INVENTION

Accordingly, it is an object of the present invention to provide a swash plate type compressor which can reduce the vibration of a swash plate using a very simple structure.

It is another object of the present invention to provide a compressor capable of extending the life of the thrust bearing.

To achieve the foregoing and other objects and in accordance with the purpose of the present invention, there is provided a compressor having a drive shaft rotatably supported in a cylinder block. A swash plate rotates in accordance with rotation of the drive shaft. A plurality of pistons reciprocate in the associated cylinder bores in the cylinder block to compress the gas in accordance with rotation of the swash plate. First and second thrust bearings are provided in the cylinder block at both sides of the swash plate, and receive the axial loads applied to the swash plate and drive shaft by the reciprocation of the pistons. The first thrust bearing has a radially inner portion clamped at opposite sides between the swash plate and cylinder block and a radially outer portion located apart (i.e., spaced by a gap) from at least the swash plate to allow the swash plate to tilt with respect to the first thrust bearing within the clearance gap in response to a force moment applied to the swash plate when the compressor is operating.

BRIEF DESCRIPTION OF THE DRAWINGS

The features of the present invention that are believed to be novel are set forth with particularity in the appended claims. The invention, together with objects and advantages thereof, may best be understood by reference to the following description of the presently preferred embodiments together with the accompanying drawings in which:

DETAILED DESCRIPTION OF THE PREFERRED EMBODIMENTS

Figure 1:
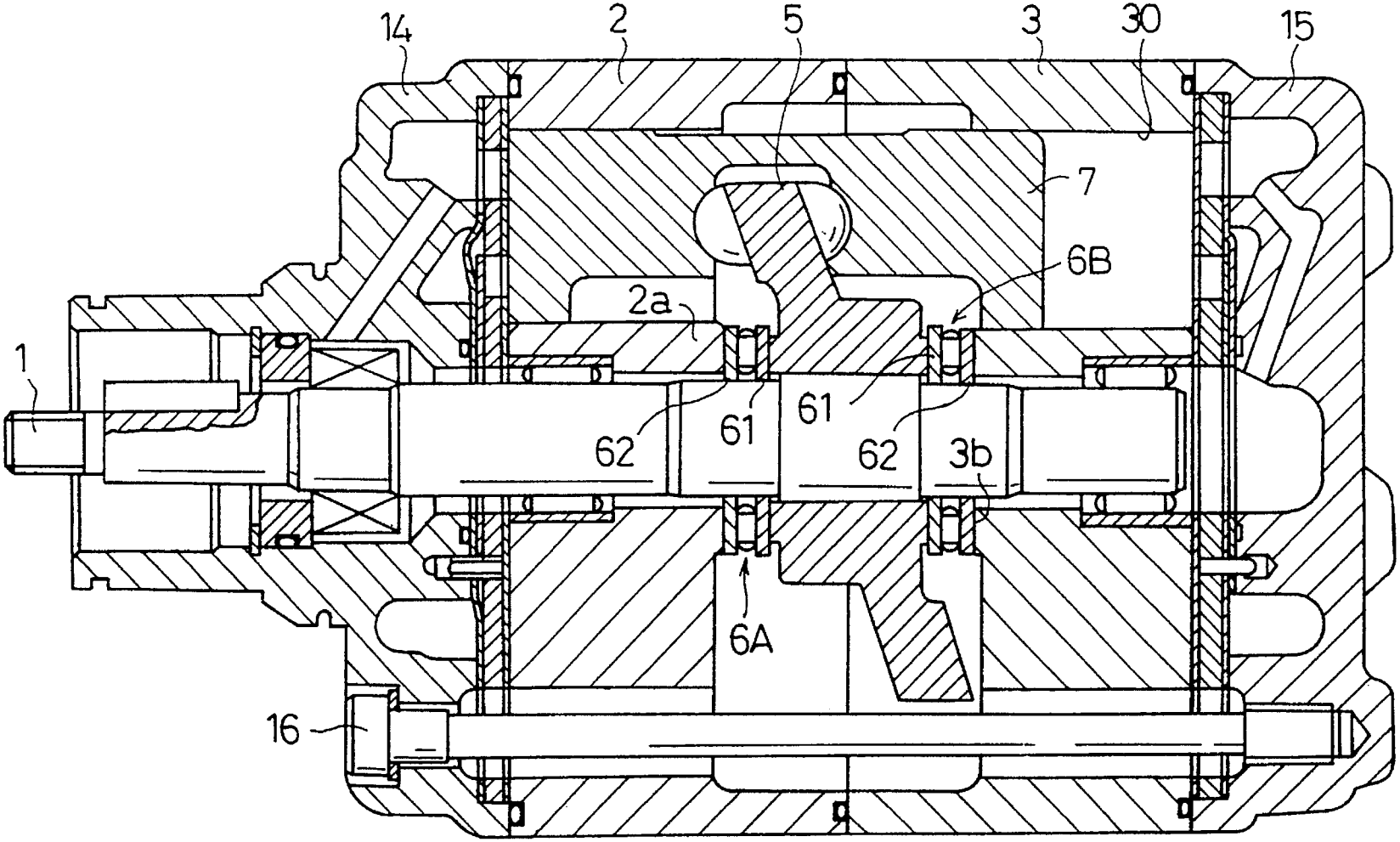
FIG. 1 is a cross-sectional side elevation view of a compressor according to a first embodiment of the present invention.

A swash plate type compressor according to a first embodiment of the present invention will be described in detail with reference to FIGS. 1 and 2.

The swash plate type compressor incorporates a pair of cylinder blocks 2 and 3. A drive shaft 1 is rotatably supported by the pair of cylinder blocks 2 and 3. A swash plate 5 is mounted on the drive shaft 1. Thrust bearings 6A and 6B are respectively interposed between the swash plate 5 and the cylinder blocks 2 and 3. Each of the thrust bearings 6A and 6B has an annular inner rate 61 (the race adjacent the swash plate) and an annular outer race 62 (the race adjacent the cylinder block). The inner race 61 and the outer race 62 have nearly the same diameter.

The outer ends of both cylinder blocks 2 and 3 are blocked by housings 14 and 15. Bolts 16 securely fix the individual cylinder blocks 2 and 3 and the housings 14 and 15, so that the individual thrust bearings 6A and 6B are held between the swash plate 5 and the cylinder blocks 2 and 3.

When the compressor runs and pistons 7 reciprocate in accordance with the rotation of the swash plate 5, the refrigerant gas is compressed and the reactive force acts as an axial load to the thrust bearings 6A and 6B via the pistons 7 and the swash plate 5.

The support structure for the thrust bearings 6A and 6B will now be described in detail. AS the pair of thrust bearings 6A and 6B are both held rigidly and have the same structure in this embodiment, only the rear thrust bearing 6B will be discussed below.

The rear thrust bearing 6B has an inner race 61, an outer race 62, rollers 63 and a holder (not shown). An orbital path is defined as the path along which the rollers 63 roll between the inner race 61 and the outer race 62. The circle passing the midway of the orbital path is defined as an orbital center circle PC, the outer diameter of the orbital path is defined as an outer orbital diameter OD, and the inner diameter of the orbital path is defined as an inner orbital diameter BD.

Figure 2:
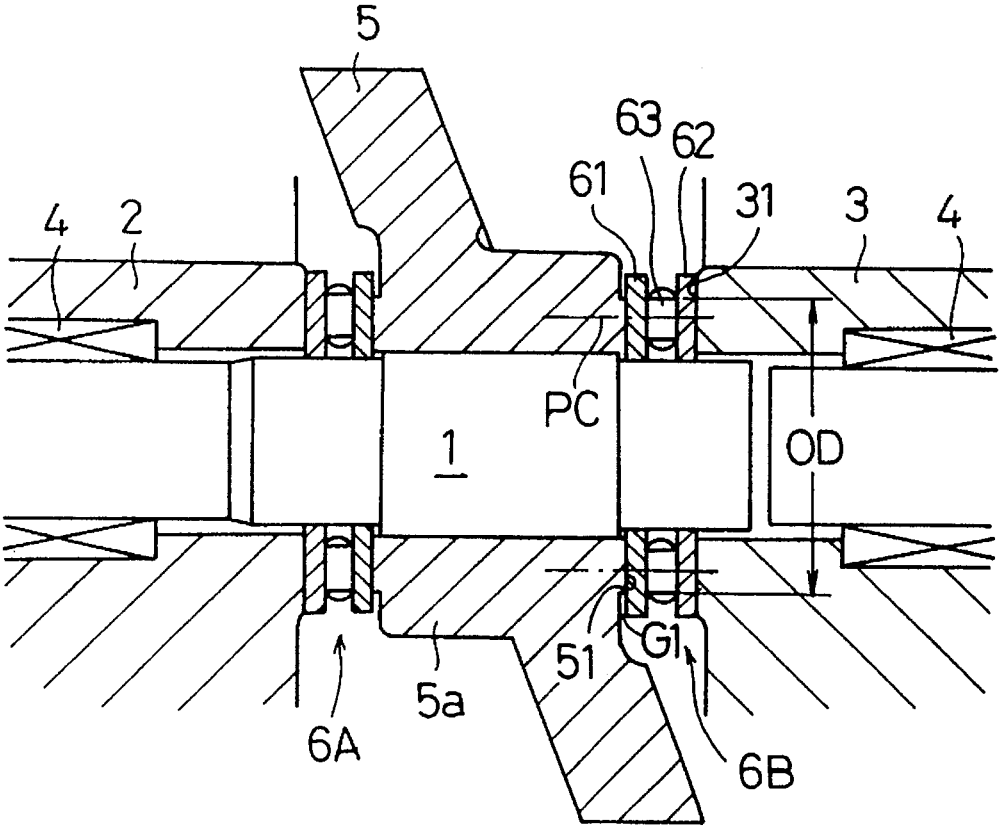
FIG. 2 is a partial cross-sectional view of the compressor shown in FIG. 1.

A flat pressure receiving seat or surface 31 is formed in the cylinder block 3 (FIG. 2). The seat 31 contacts the entire outer race 62. A pressure receiving seat or surface 51 is formed in a boss portion 5*a* of the swash plate 5. The seat 51 has a ring shape and has almost the same area as the orbital path. The seat 51 has an outer diameter smaller than that of the inner race 61. The seat 51 contacts the inner race 61, forming a desired clearance G1 between the boss portion 5*a* and the radially outer region of the outer surface of the inner race 61.

Figure 3:
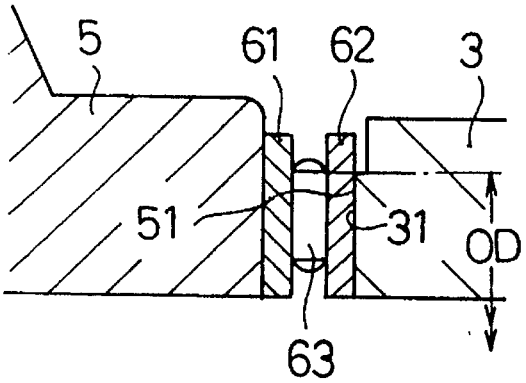
FIG. 3 is a partial enlarged cross-sectional view of a compressor according to a modification of the first embodiment.

It is preferable that the outer diameter of the seat 51 be about the same as the outer orbital diameter OD of the thrust bearing 6B. Of course, the outer diameter of the seat 51 may be set smaller than the outer orbital diameter OD. This pressure receiving seat 51 may be formed in the cylinder block 3 as shown in FIG. 3 in place of the swash plate 5. Further, with respect to FIG. 2, the seat 31 of the cylinder block 3 may be modified to have the same shape as the seat 51 of the boss portion 5*a*.

Figure 4:
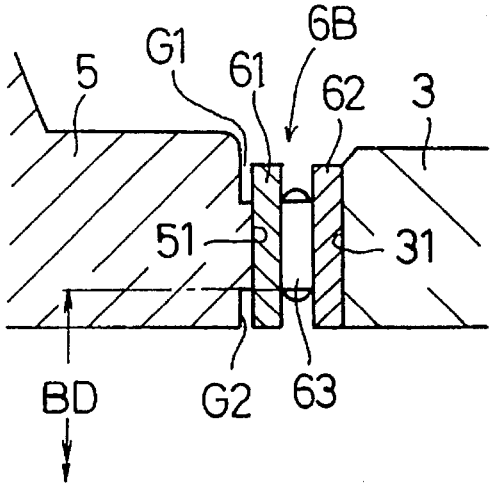
FIG. 4 is a partial enlarged cross-sectional view of a compressor according to another modification of the first embodiment.

In a modification shown in FIG. 4, the inner diameter of the seat 51 is set approximately equal to the inner orbital diameter BD of the thrust bearing 6B. A clearance or gap space G2 is formed between the boss portion 5*a* and the radially inner region of the outer surface of the inner race 61.

In the conventional compressor, when the moment based on the compressive reaction force of the gas acts on the swash plate 5, a heavy offset load acts on the peripheral portion of the orbital path of the inner race and outer race. According to this embodiment, at least one pressure receiving seat, 51, has a smaller outside diameter than the inner race 61 to secure the clearance G1 between the boss portion 5*a* of the swash plate 5 and the radically outer region of the outer surface of the inner race 61. The moment is therefore not transmitted to the orbital plane, nullifying the offset load acting on the orbital plane.

In the modification in FIG. 4, a change in the moment can be effectively nullified by a minute deformation which occurs at the inner wall portion of the inner race 61.

Figure 8:
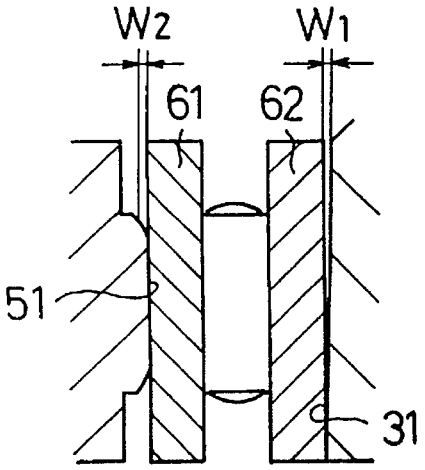
FIG. 8 is an enlarged partial cross-sectional view for explaining the crowning effect of a thrust bearing.

This will be further discussed with reference to FIG. 8. When the swash plate 5 rotates, the outer race 62 rotates in response to the movement of the swash plate 5, causing the outer race 62 and the seat 31 to slide against each other. This wears both parts 62 and 31 on the order of microns, thereby forming a minute gap W1 between them. This gap is desirable to nullify a variation in moment.

The inner race 61, unlike the outer race 62, does not rotate such in response to the rotation of the swash plate 5. However, the ring shape of the seat 51, employed to substantially reduce its area, and the minute deformation of the inner race 61 causes the seat 51 of the swash plate 5 to wear thereby forming a minute gap W2. The gap W2 is sufficient to nullify a variation in moment with respect to the swash plate 5 and creates an excellent crowing effect to reduce the concentration of load on the end portions of the rollers.

Figure 5:
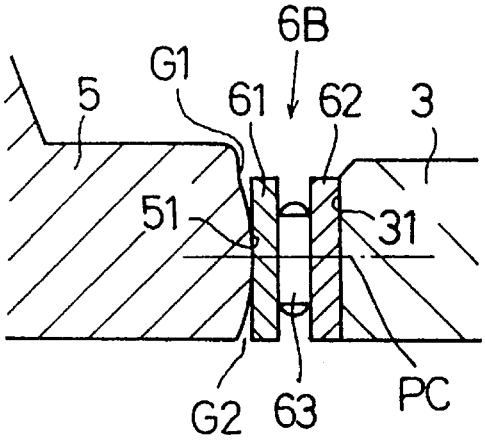
FIG. 5 is a partial enlarged cross-sectional view of a compressor according to a second embodiment.

FIG. 5 shows a second embodiment in which the seat 51 of the boss portion 5*a* of the swash plate 5 has an arcuate cross section. A convex surface of the seat 51 contacts the inner race 61 on the orbital center circle PC of the thrust bearing 6B. A line of contact is maintained between the seat 51 and the inner race 61. The clearance G1 and G2 are formed between the outer and inner peripheries, respectively, of the inner race 61 and the seat 51. The remaining structure of the second embodiment is the same as the first embodiment.

Even when the moment acting on the swash plate 5 changes, therefore, the difference between the loads acing on the inner peripheral portion of the orbital path of the thrust bearing 6B is reduced considerably. Likewise, the minute deformation of the inner race 61 can effectively absorb the variable load.

Figure 6:
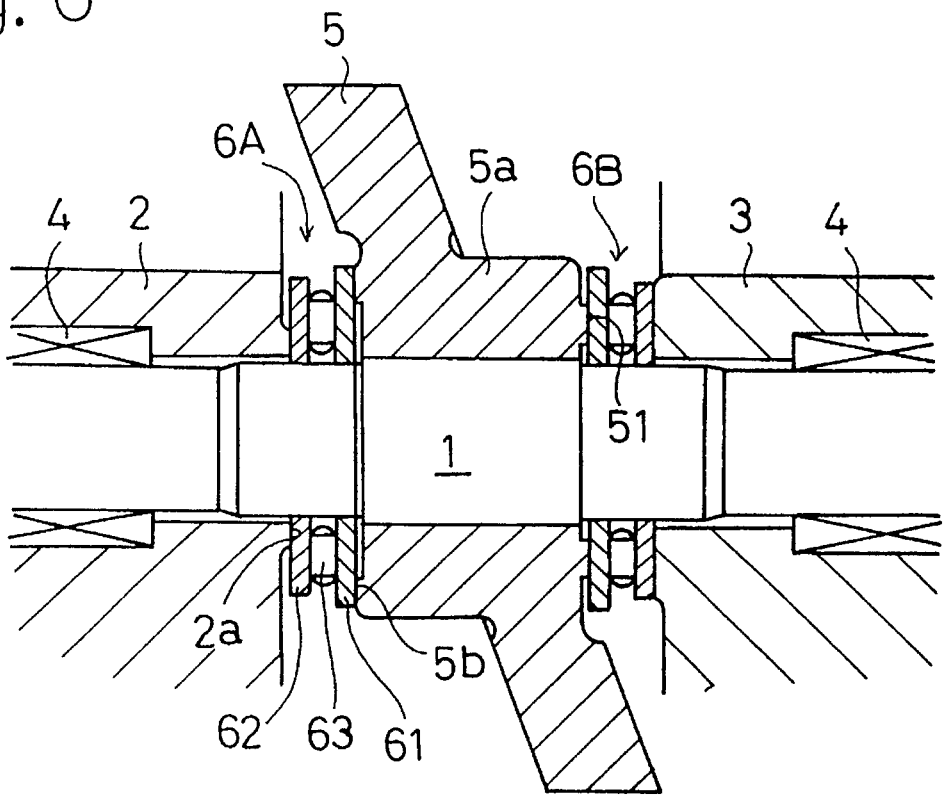
FIG. 6 is a partial cross-sectional view of a compressor according to a third embodiment.

In a third embodiment shown in FIG. 6, the rear thrust bearing 6B is provided with the seat as discussed in the foregoing descriptions and the front thrust bearing 6A is given a buffer function so that the axial load is absorbable.

An annular pressure receiving seat 5*b* having a relatively large diameter is formed on the front surface of the boss portion 5*a* of the swash plate 5. The inner race 61 of the front thrust bearing 6*a* is engaged with the seat 5*b* in the vicinity of its radially outer peripheral portion. An annular pressure receiving seat 2*a* having a relatively small diameter is formed on the cylinder block 2. The outer race 62 of the front thrust bearing 6A is engaged wit the seat 2*a* in the vicinity of its radially inner portion. To give both thrust bearings 6A and 6B the common functions and components in this embodiment, the inner races 61 of both thrust bearings 6A and 6B are formed larger in diameter than the outer races 62.

When the boss portion 5*a* of the swash plate 5 is held between both cylinder blocks 2 and 3 via the thrust bearings 6A and 6B, therefore, the races 61 and 62 engaging the seats 5*b* and 2*a* of different diameters elastically deform. When the tightening of the bolts is more than is needed, the excess force is absorbed by the front thrust bearing due to the deformation. This eliminates the adjustment of the fastening force of the bolts and simplifies the assembly work.

When the compressor runs and the moment based on the compressive reaction force of the gas acts on the swash plate 5, the rear thrust bearing 6B held stably supports the swash plate 5 by its rigidity. The variable axial load is properly absorbed by the front thrust bearing 6A having the buffer function.

Figure 7:
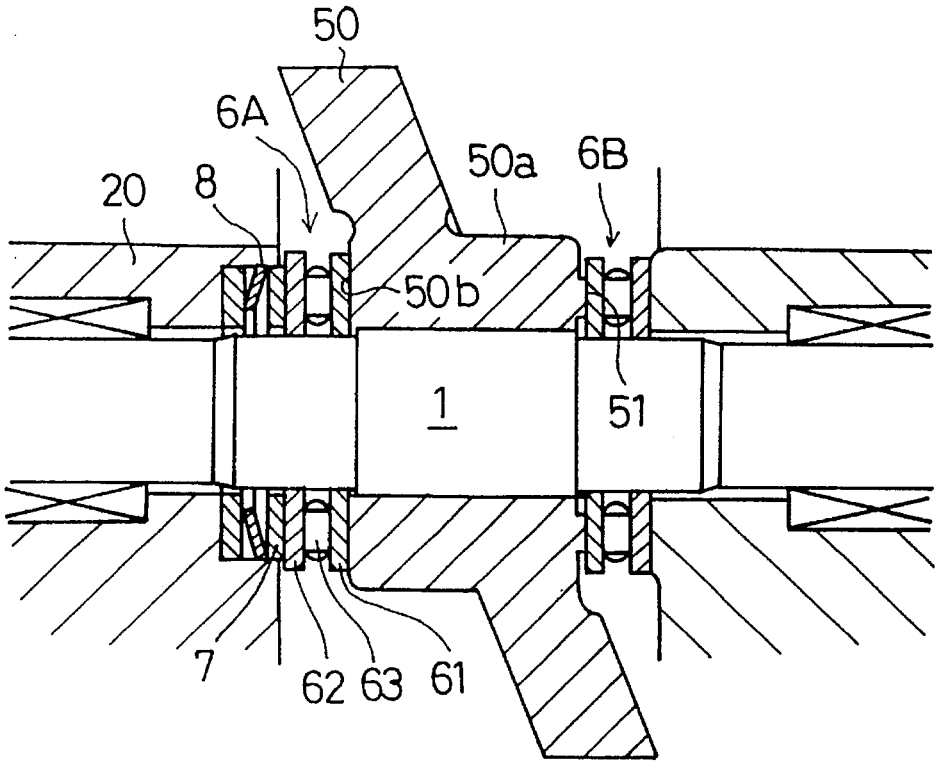
FIG. 7 is a partial cross-sectional view showing the essential parts of a compressor according to a fourth embodiment.

FIG. 7 shows a fourth embodiment in which the structure of the front thrust bearing 6A differs from that in the third embodiment. A boss portion 50*a* of a swash plate 50 has a flat pressure receiving seat 50*b* which is engaged with the inner race 61. A washer 7 and a belleville spring 8 are housed around the drive shaft 1 in a cylinder block 20, with the outer race 62 engaged with the belleville spring 8 via the washer 7. In other words, in this embodiment, the buffer function to absorb the axial load is not given to the thrust bearing 6A itself, but depends on the inherent elastic deformation of the belleville spring 8 between the cylinder block 20 and the front thrust bearing 6A. Therefore, the buffer function can easily be adjusted by properly selecting the spring constant of the belleville spring 8.

Instead of the front thrust 6A, the rear thrust bearing 6B may be given the buffer function. The belleville spring may be replaced with a coil spring, a roll spring or the like.

Figure 9:
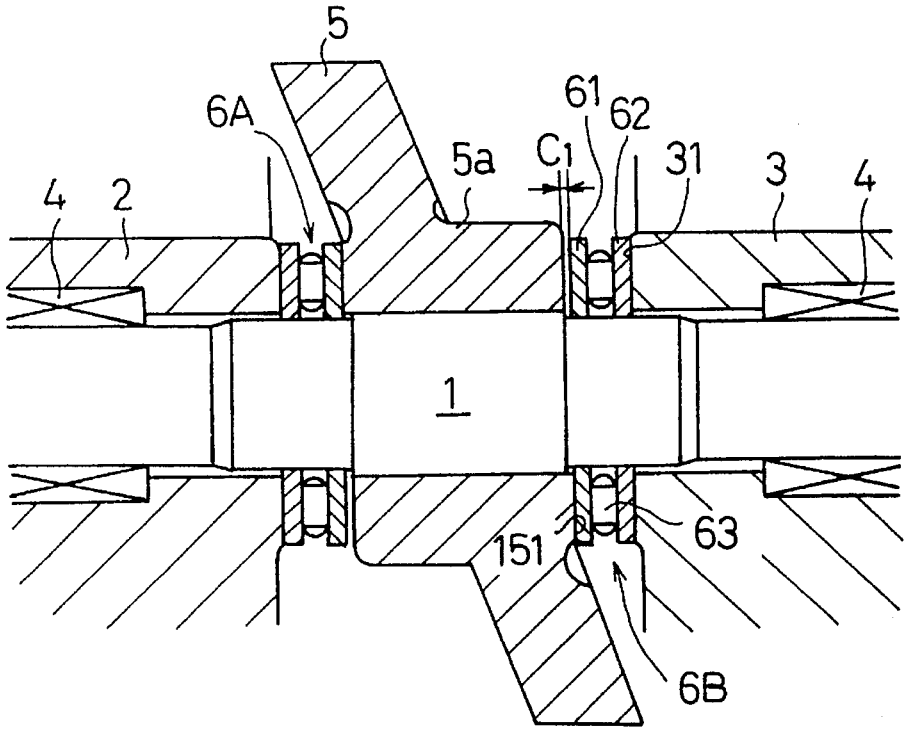
FIG. 9 is a partial cross-sectional view of a compressor according to a fifth embodiment of this invention.
Figure 10:
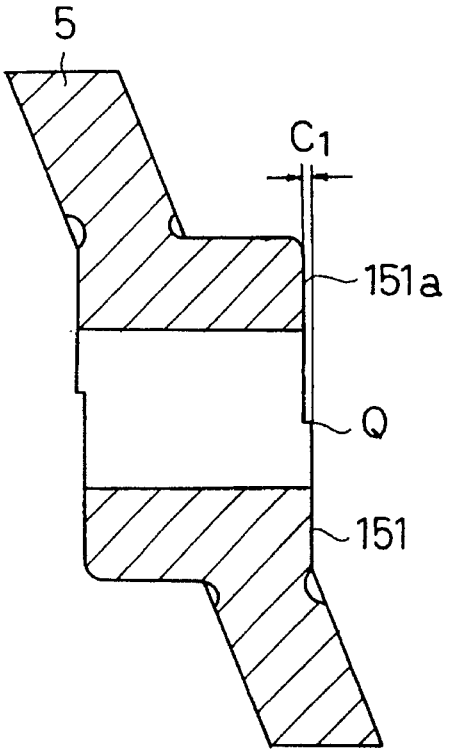
FIG. 10 is a cross-sectional view of the swash plate of the compressor in FIG. 9.
Figure 11:
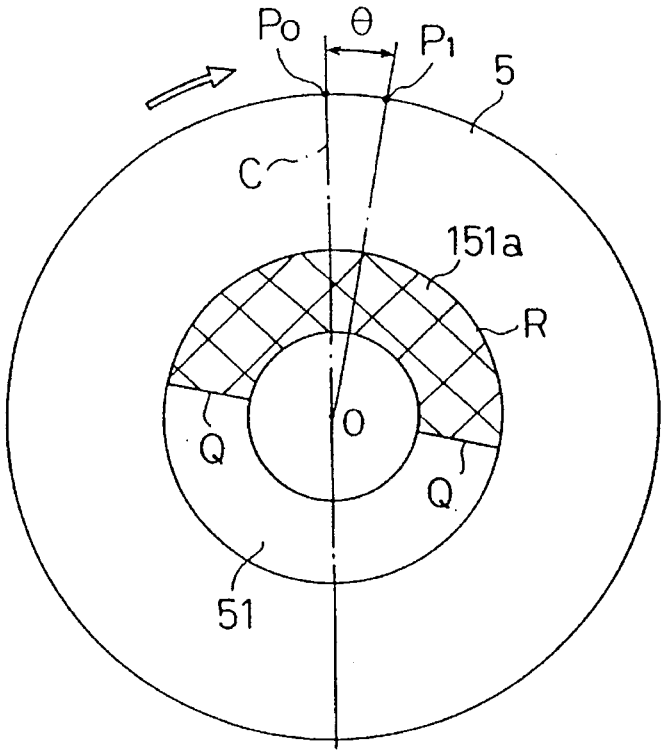
FIG. 11 is a front view of the swash plate of the compressor in FIG. 9.

A fifth embodiment of this invention will not be described with reference to FIGS. 9 through 11.

The rear thrust bearing 6B in this embodiment has the inner race 61, outer race 62, rollers and 63 and holder (not shown) as in the above-described embodiments. The flat pressure receiving seat 31 formed in the cylinder block 3 is engaged with the entire outer surface of the outer race 62. A pressure receiving seat 151 formed on the boss portion 5*a* of the swash plate 5 is formed with an escape portion 151*a*, as clearly shown in FIGS. 10 and 11.

This escape portion 151*a* is formed by cutting the boss portion 5*a* to a predetermined thickness within an area R (the shaded area in FIG. 11) nearly semiannular in shape. The area R is symmetric with respect to a point P1 separated by a predetermined angle θ along the rotational direction of the swash plate 5 from a dead point P0 where the perpendicular line C passing the center O of the swash plate 5 intersects the peripheral edge of the swash plate 5. A moment acting on the swash plate 5 based on the reactive force applied to each piston 7 represents a maximum in a specific phase where the swash plate 5 advances slightly by the angle θ from the dead point P0. The formation of the escape portion 151*a* forms a desired clearance or space C1 between the boss portion 5*a* and the inner race 61.

Figure 12:
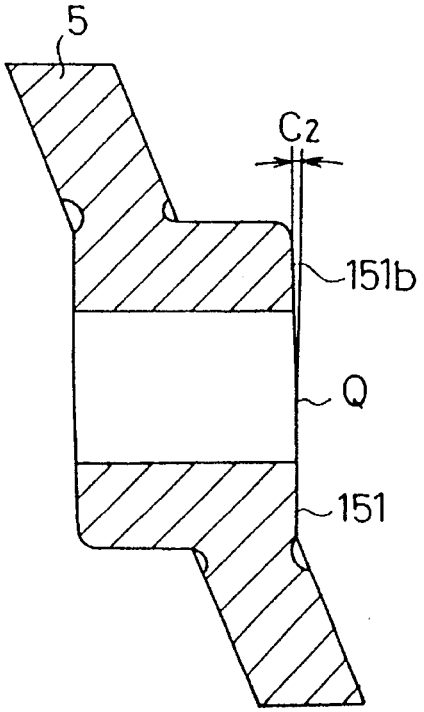
FIG. 12 is a cross-sectional view of the swash plate of a modification of the fifth embodiment.

FIG. 12 shows a modification of the escape portion 151*a*. An escape portion 151*b* in this modification is formed by cutting away the aformentioned semiannular area R obliquely from the center of the boss portion 5 toward the outer periphery. As a result, a clearance C2 which gradually becomes wider from the center of the boss portion 5 toward the outer periphery is formed between the boss portion 5 and the inner race 61.

When the moment based on the compressive reaction force of the gas acts on the swash plate 5, it is transmitted via the boss portion 5*a* to the inner race 61. In this embodiment, however, the clearance or gap C1 or C2 allows the inner race 61 to deform. The moment which has not been absorbed by that deformation is transmitted via the drive shaft 1 to a radial bearing 4 and is received there. In this way, the load on the thrust bearing 6B is reduced.

Further, the load is always evenly received at a pair of chords Q of the seat 151 of the magnitude of the load. It is thus possible to cancel most of the offset load acting on the orbital path of the thrust bearing 6B.

Figure 13:
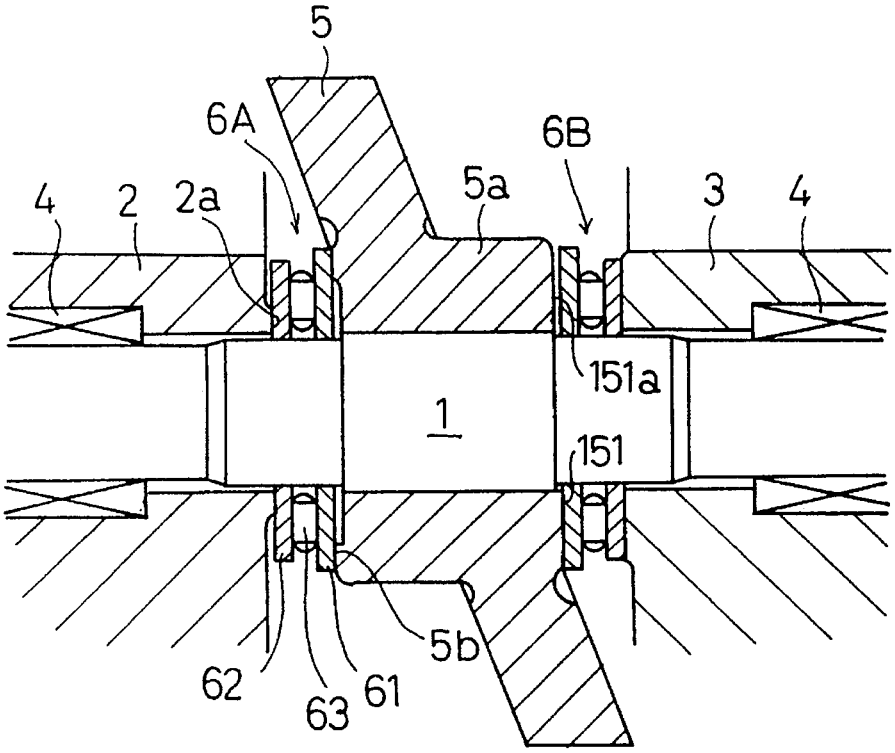
FIG. 13 is a partial cross-sectional view of a compressor according to a sixth embodiment.

FIG. 13 shows a sixth embodiment. In this embodiment, the rear thrust bearing 6B has the same structure as that of the fifth embodiment shown in FIG. 9, and the front thrust bearing 6A has substantially the same structure as that of the third embodiment shown in FIG. 6. See the descriptions of the third and fifth embodiments for the structures of the individual parts of the sixth embodiment.

In the sixth embodiment, when the moment based on the compressive reaction force of the gas acts on the swash plate 5, it is received by the rear thrust bearing 6B and the radial bearing 4. The variable axial load is properly absorbed by the front thrust bearing 6A having the buffer function.

Figure 14:
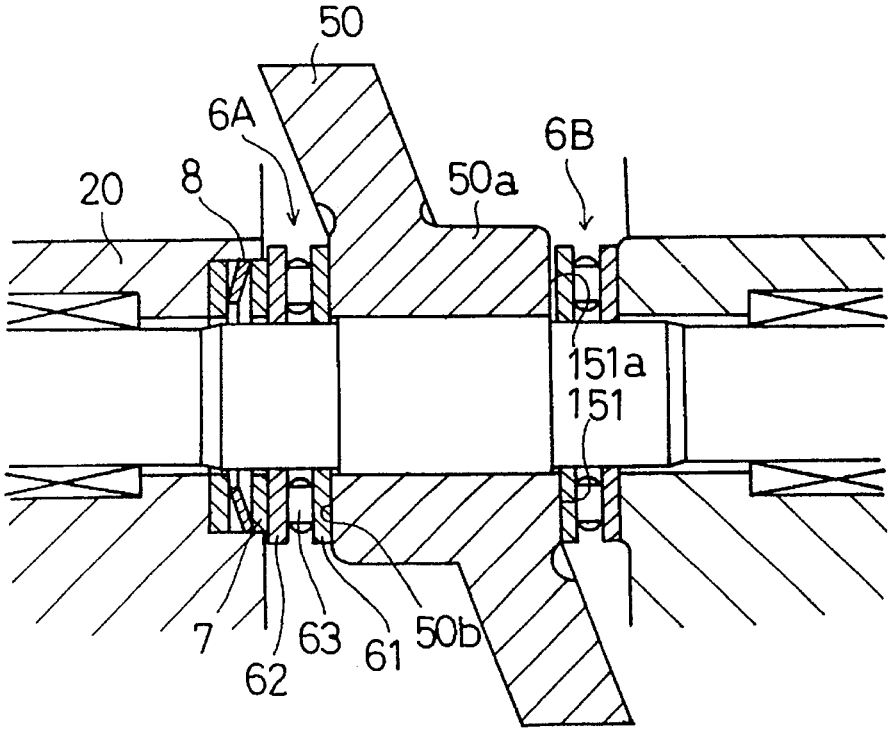
FIG. 14 is a partial cross-sectional view of a compressor according to a seventh embodiment.

FIG. 14 shows a seventh embodiment. In this embodiment, the rear thrust bearing 6B has the same structure as that of the fifth embodiment shown in FIG. 9, and the front thrust bearing 6A has the same structure as that of the fourth embodiment shown in FIG. 7. See the descriptions of the fourth and fifth embodiments for the structures of the individual parts of the seventh embodiment.

In addition to having the function and advantages of the compressor of the sixth embodiment, the compressor of the seventh embodiment can ensure easy adjustment of the buffer function by properly selecting the spring constant of the belleville spring 8.

Figure 15:
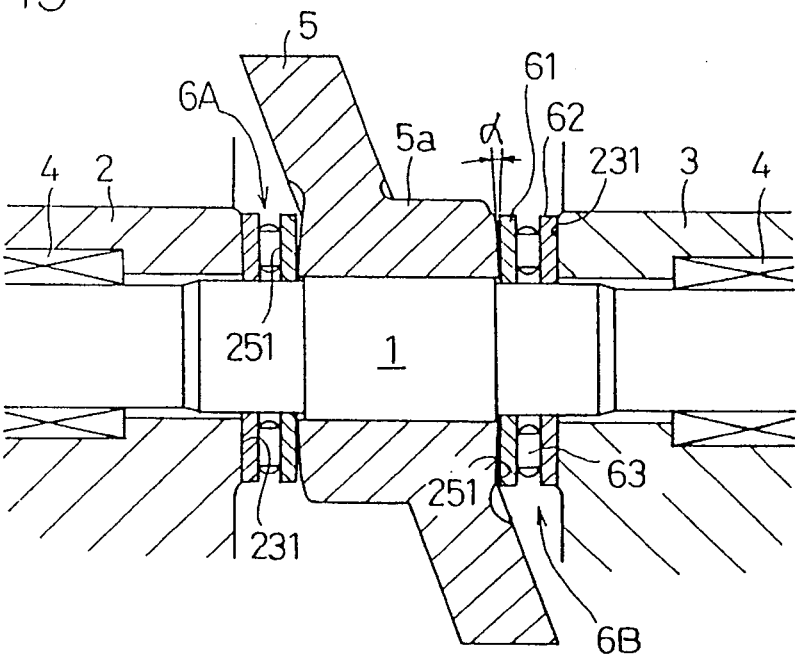
FIG. 15 is a partial cross-sectional view of a compressor according to an eighth embodiment.

An eighth embodiment of this invention will now be discussed referring to FIG. 15.

A compressor according to this embodiment has front and rear thrust bearings 6A and 6B having the same structure in the front and back of the swash plate 5. The rear thrust bearing 6B has the inner race 61, outer race 62, rollers 63 and holder (not shown) as in the above-described embodiments. A flat pressure receiving seat 231 formed in the cylinder block 3 is engaged with nearly the entire outer surface of the outer race 62. A pressure receiving seat 251 is formed in a truncated cone shape on the boss portion 5*a* of the swash plate 5. This pressure receiving seat 251 is engaged with the radially central portion of the inner race 61 forming a clearance, space or gap in a given angular range α (about 0.02 to 0.5 degree) between the outer peripheral portion of the seat 251 and the inner race 61. The width of this clearance gradually increases from the center portion of the seat 251 toward the peripheral edge thereof.

When the moment based on the compressive reaction force of the gas acts on the swash plate 5, the moment is transmitted to the inner race 61 via the boss portion 5*a*. Since the clearance of the given angular range α is provided in this embodiment, deformation of the peripheral portion of the inner race 61 is allowed. The moment which has not been absorbed by this deformation is transmitted via the drive shaft 1 to the radial bearing 4 and is received there. This reduces the loads on the thrust bearings 6A and 6B.

Figure 16:
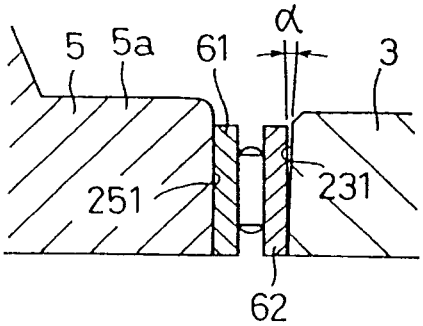
FIG. 16 is a partial enlarged cross-sectional view showing a modification of the eighth embodiment.

The seat 231 of the cylinder block 3 may be formed in the same manner as the seat 251 of the swash plate 5 as shown in FIG. 16. Further, both pressure receiving seats 251 and 231 may be formed in a truncated cone shape.

Figure 17:
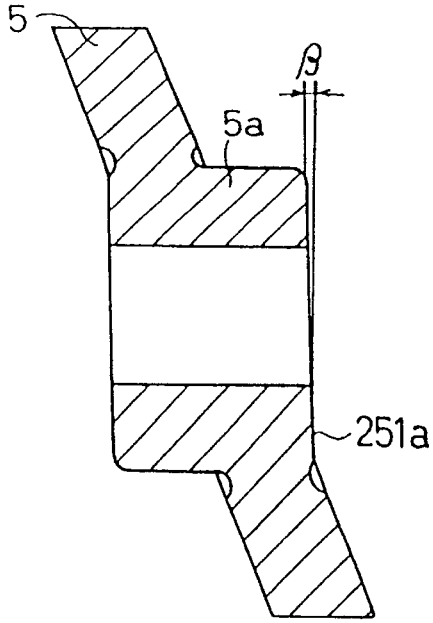
FIG. 17 is a cross-sectional view of the swash plate of another modification of the eighth embodiment.

FIG. 17 shows a modification of the seat of the swash plate 5. This pressure receiving seat 251*a* has a similar structure to that of the seat 151 of the fifth embodiment shown in FIG. 12. The seat 251*a* is nearly entirely inclined by a predetermined angle β (about 0.02 to 0.5 degree) with respect to the plane that is normal to the drive shaft 1 so that the clearance between the seat 251*a* and the inner race 61 becomes maximum at the point where the moment acting on the seat 251*a* becomes maximum. The width of this clearance increases from one end of the boss portion 5*a* of the swash plate 5 to the other end. This also reduces the load on the thrust bearing 6B as in the previous embodiment.

Figure 18:
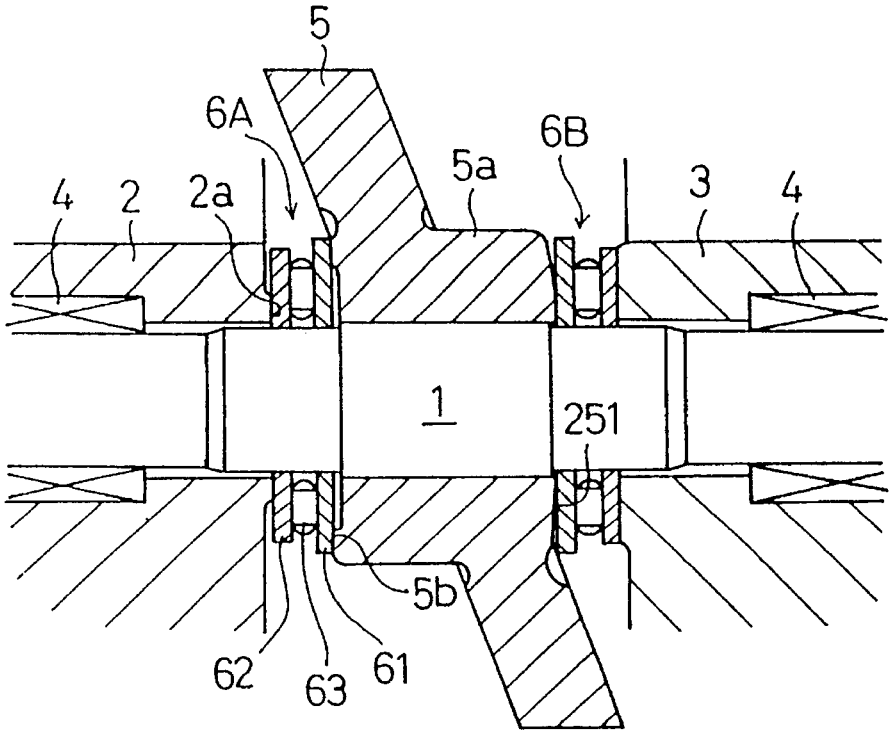
FIG. 18 is a partial cross-sectional view of a compressor according to a ninth embodiment.

FIG. 18 shows a ninth embodiment. The rear thrust bearing 6B in this embodiment has the same structure as that of the eighth embodiment shown in FIG. 15, and the front thrust bearing 6A has substantially the same structure as that of the third embodiment shown in FIG. 6. See the descriptions of the third and eighth embodiments for the structures of the parts of the ninth embodiments.

In the ninth embodiment, when the moment based on the compressive reaction force of the gas acts on the swash plate 5, it is received by the rear thrust bearing 6B and the radial bearing 4. The variable axial load is properly absorbed by the front thrust bearing 6A having the buffer function.

Figure 19:
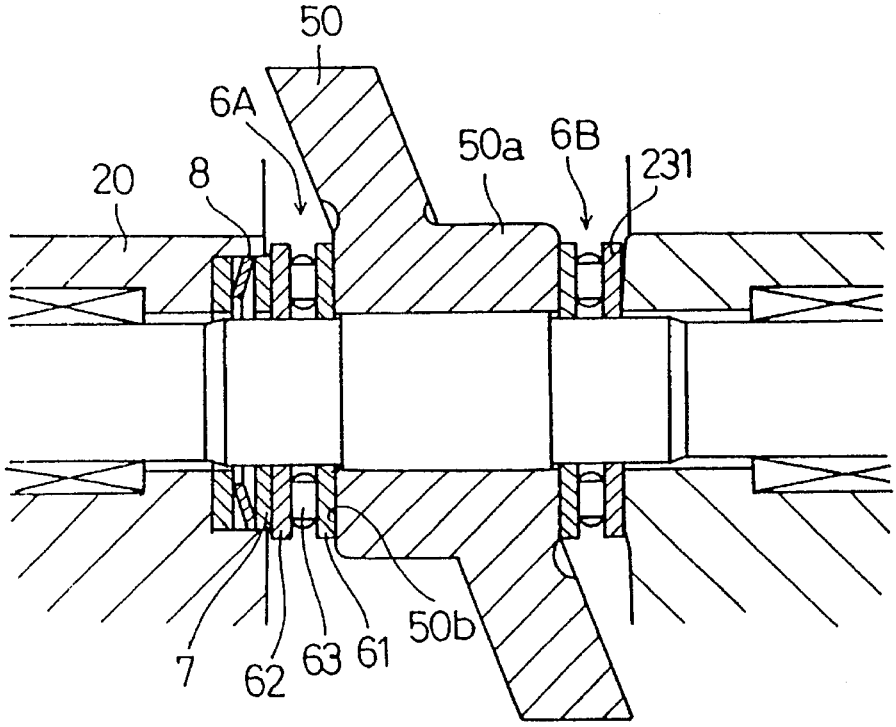
FIG. 19 is a partial cross-sectional view of a compressor according to a tenth embodiment.
Figure 20:
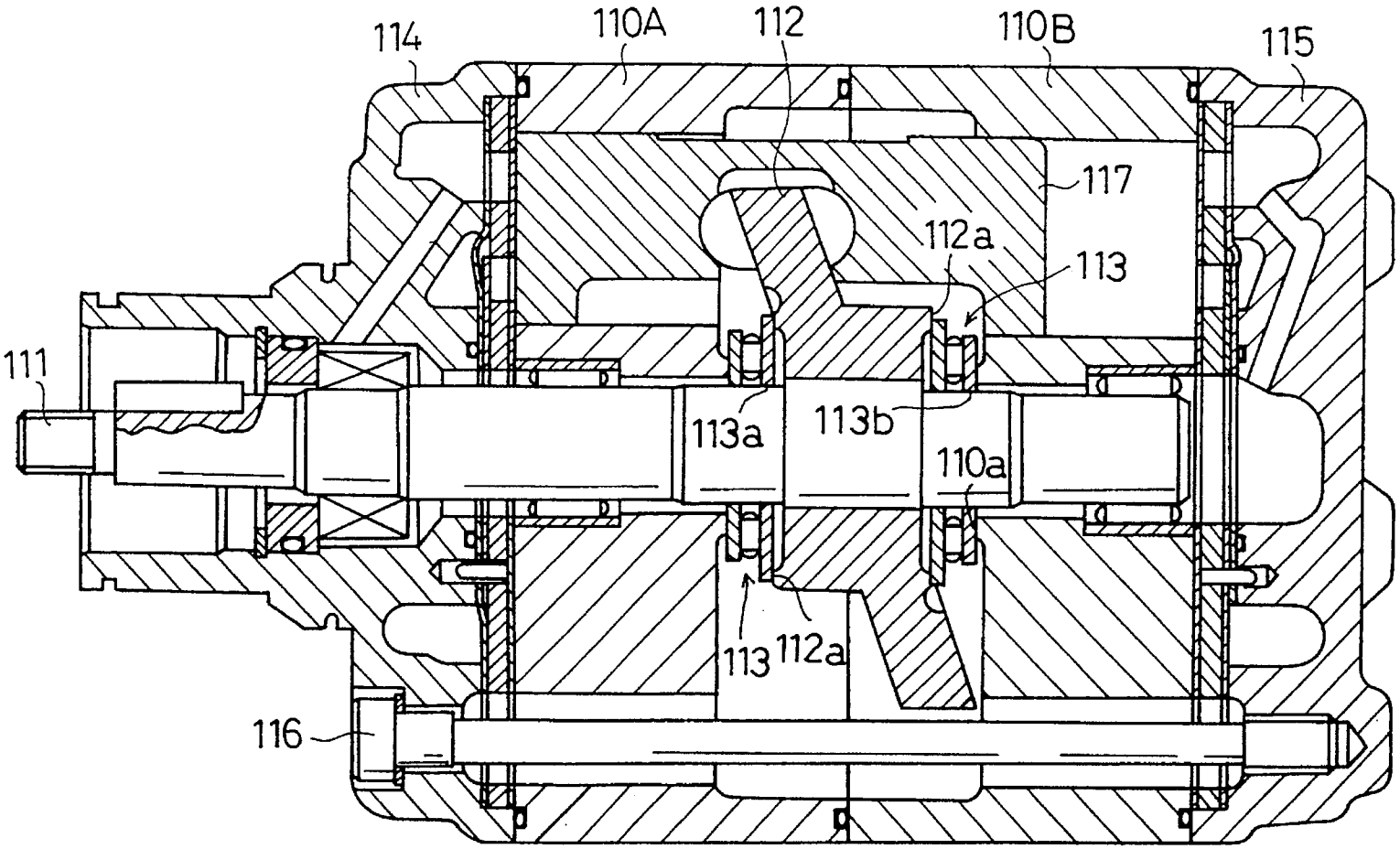
Fig. 20 (Prior Art)
FIG. 20 is a cross-sectional side elevation view of a conventional compressor.
Figure 21:
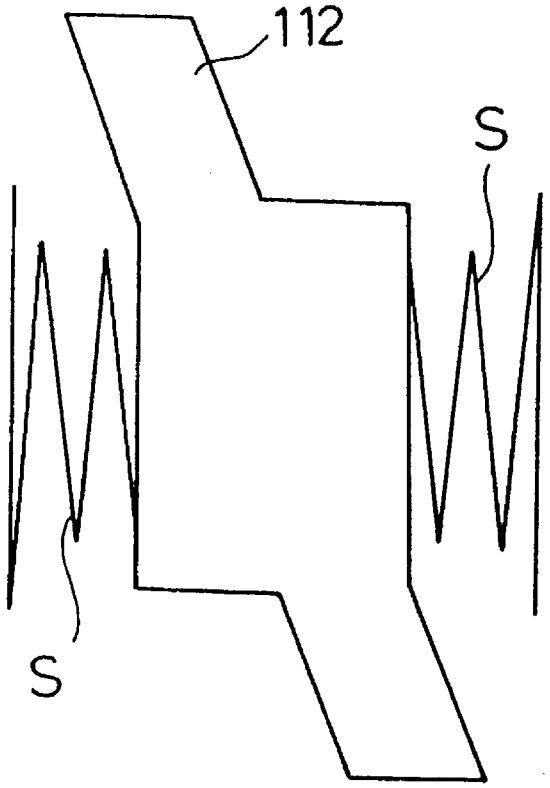
Fig. 21 (Prior Art)
FIG. 21 is a schematic side view of the swash plate in FIG. 20.

FIG. 19 shows a tenth embodiment. The rear thrust bearing 6B in this embodiment has the same structure as that of the eighth embodiment shown in FIG. 15, and the front thrust bearing 6A has substantially the same structure as that of the fourth embodiment shown in FIG. 7. See the descriptions of the fourth and eighth embodiments for the structures of the parts of the tenth embodiment.

In addition to having the function and advantages of the compressor of the ninth embodiment, the compressor of the tenth embodiment ensures easy adjustment of the buffer function by properly selecting the spring constant of the belleville spring 8.

What is claimed is:

1. A compressor having a drive shaft rotatably supported in a cylinder block, a swash plate coupled to said drive shaft for rotation in accordance with rotation of the drive shaft, and a plurality of pistons reciprocating in associated cylinder bores in said cylinder block to compress gas in accordance with rotation of said swash plate, said compressor comprising:

a first thrust bearing and a second thrust bearing provided in said cylinder block, with said first thrust bearing located on one side of said swash plate and said second thrust bearing located on the opposite side of said swash plate for receiving axial loads applied to said swash plate and said drive shaft upon reciprocation of said pistons;

said first thrust bearing having a radially inner portion clamped at opposite sides thereof between the swash plate and the cylinder block and a radially outer portion spaced by a clearance gap from at least the swash plate to allow the swash plate to tilt with respect to the first thrust bearing within the clearance gap in response to a force moment applied to the swash plate when the compressor is operating.

2. A compressor according to claim 1, wherein said first thrust bearing includes:

an inner race in engagement with the swash plate;

an outer race in engagement with the cylinder block;

an annular orbital path defined between said inner race and said outer race, said orbital path having an outer diameter and an inner diameter; and a plurality of rollers disposed for rolling along said orbital path.

3. A compressor according to claim 2, wherein said swash plate and cylinder block have surfaces for receiving axial loads, each surface engaging one of the inner race and the outer race at the inner portion of the first thrust bearing.

4. A comprssor according to claim 3, wherein said surface of the swash plate has an annular shape around the drive shaft, said surface having an outer diameter substantially equal to the outer diameter of the orbital path.

5. A compressor according to claim 3, wherein said surface of the cylinder block had an annular shape around the drive shaft, said surface haivng an outer diameter substantially equal to the outer diameter of the orbital path.

6. A compressor according to claim 4, wherein said surface of the swash plate has an inner diameter substantially equal to the inner diameter of the orbital path.

7. A comprssor according to claim 3, wherein said surface of the swash plate includes a convex surface making a line contact with the first thrust bearing.

8. A compressor according to claim 1, wherein said second thrust bearing functions to buffer the axial loads.

9. A compressor according to claim 8, further comprising:

annular seats formed on the swash plate and the cylinder block and having different diameters from each other, said seats engaging opposite sides of the second thrust bearing and allowing the second thrust bearing to be deformed to buffer the axial loads.

10. A compressor according to claim 1 further comprising:

means for urging the second thrust bearing toward the first thrust bearing.

11. A compressor having a drive shaft rotatably supported in a cylinder block, a swash plate coupled to said drive shaft for rotation in accordance with rotation of the drive shaft, and a plurality of pistons reciprocating in associated cylinder bores in said cylinder block to compress gas in accordance with rotation of said swash plate, said compressor comprising:

a first thrust bearing and a second thrust bearing provided in said cylinder block, with said first thrust baring located on one said of said swash plate and said second thrust bearing located on the opposite side of said swash plate for receiving axial loads applied to said swash plate and said drive shaft upon reciprocation of said pistons;

said first thrust bearing having:

a radially inner portion clamped at opposite sides thereof between the swash plate and the cylinder block;

a radially outer portion spaced by a clearance gap from at least the swash plate to allow the swash plate to tilt with respect to the first thrust bearing within the clearance gap in response to a force moment applied to the swash plate when the compressor is operating;

an inner engaging the swash plate;

an outer race engaging the cylinder block;

an annular orbital path defined between the inner race and outer race, said orbital path having an outer diameter and an inner diameter; and a plurality of rollers capable of rolling along the orbital path; and wherein said swash plate and cylinder block have surfaces for receiving the axial loads, each surface engaging the respective adjacent inner and outer race at the first portion of the first thrust bearing.

12. A compressor according to claim 11, wherein said surface of the swash plate has an annular shape around the drive shaft, said surface having an outer diameter substantially equal to the outer diameter of the orbital path.

13. A compressor according to claim 11, wherein said surface of the cylinder block has an annular shape around the drive shaft, said surface having an outer diameter substantially equal to the outer diameter of the orbital path.

14. A compressor according to claim 12, wherein said surface of the swash plate has an inner diameter substantially equal to the inner diameter of the orbital path.

15. A compressor according to claim 11, wherein said swash plate has an escape section forming a clearance with the inner race of the first thrust bearing at the second portion of the first thrust bearing.

16. A compressor according to claim 15, wherein said swash plate has a boss having a front surface, sand said escape portion is formed over substantially one half of said front surface of the boss.

17. A compressor according to claim 16, wherein said escape section inclines from the longitudinal central axis of the swash plate toward the periphery of the swash plate.

18. A compressor according to claim 11, wherein said second thrust bearing functions to buffer the axial loads.

19. A compressor according to claim 18, further comprising:

annular seats formed on the swash plate and the cylinder block and having different diameters from each other, said seats engaging opposite sides of the second thrust bearing and allowing the second thrust bearing to be deformed to buffer the axial loads.

20. A compressor according to claim 11 further comprising:

means for urging the second thrust bearing toward the first thrust bearing.

21. A compressor according to claim 11, wherein said axial load receiving surface of the swash plate has a truncated cone shape with a radially central section engaging said inner race and a peripheral section spaced by a gap from said inner race of the first thrust bearing.

22. A compressor according to claim 11, wherein said surface of the swash plate inclines by a predetermined angle with respect to a plane perpendicular to the drive shaft.

23. A compressor according to claim 21, wherein said second thrust bearing functions to buffer the axial loads.

24. A compressor according to claim 23, further comprising:

annular seats formed on the swash plate and the cylinder block and having different diameters from each other, said seats engaging opposite sides of the second thrust bearing and allowing the second thrust bearing to be deformed to buffer the axial loads.

25. A compressor according to claim 21 further comprising:

means for urging the second thrust bearing toward the first thrust bearing.

26. A compressor having a drive shaft rotatably supported in a cylinder block, a swash plate coupled to said drive shaft for rotation in accordance with rotation of the drive shaft, and a plurality of pistons reciprocating in associated cylinder bores in said cylinder block to compress gas in accordance with rotation of said swash plate, said compressor comprising:

a first thrust bearing and a second thrust bearing provided in said cylinder block, with said first thrust bearing located on one side of said swash plate and said second thrust bearing located on the opposite side of said swash plate for receiving axial loads applied to said swash plate and drive shaft upon reciprocation of said pistons;

said first thrust bearing having a radially inner portion clamped at opposite sides thereof continuously around its entire circumference between the swash plate and the cylinder block, and having a radially outer portion spaced by a clearance gap from at least one of the swash plate and the cylinder block to allow the swash plate to tilt with respect to the first thrust bearing within the clearance gap in response to a force moment applied to the swash plate when the compressor is operating.

* * * * *

UNITED STATES PATENT AND TRADEMARK OFFICE

CERTIFICATE OF CORRECTION

PATENT NO. : 5,596,920

DATED : January 28,1997

INVENTOR(S) : S. Umemura et al

It is certified that error appears in the above-indentified patent and that said Letters Patent is hereby corrected as shown below:

Title page, item [57],

In the Abstract, line 5, "an" should read --and--.

Column 1, line 36, "during" should read --During--; line 55, "an" should read --and--.

Column 4, line 37, "radically" should read --radially--; line 53, "such" should read --much--; line 66, "clearance" should read --clearances--.

Column 5, line 21, "wit" should read --with--; line 61, after "rollers" delete "and".

Column 8, line 29, "comprssor" should read --compressor--; line 35, "had" should read --has--; line 41, "comprssor" should read --compressor--; line 64, "baring" should read --bearing--.

UNITED STATES PATENT AND TRADEMARK OFFICE

CERTIFICATE OF CORRECTION

PATENT NO. : 5,596,920

DATED : January 28,1997

INVENTOR(S) : S. Umemura et al

It is certified that error appears in the above-indentified patent and that said Letters Patent is hereby corrected as shown below:

Column 9, line 15, after "and" insert --the--; line 39, "sand" should read --and--.

Signed and Sealed this

Twenty-ninth Day of July, 1997

Bruce Lehman

*Attest:*

BRUCE LEHMAN

*Attesting Officer*

*Commissioner of Patents and Trademarks*